United States Patent [19]

Otaguro et al.

[11] Patent Number: 4,565,463

[45] Date of Patent: Jan. 21, 1986

[54] AQUEOUS INK CARTRIDGE WITH TWO PART VENT PLUG

[75] Inventors: Kunihiko Otaguro, Gunma; Hiroshi Takahashi, Saitama; Kazuma Noguchi, Tokyo; Takeshi Toyama, Saitama; Takashi Ishikawa; Isao Ebisawa, both of Ibaraki, all of Japan

[73] Assignee: Pentel Kabushiki Kaisha, Tokyo, Japan

[21] Appl. No.: 592,337

[22] Filed: Mar. 21, 1984

[30] Foreign Application Priority Data

| | | | |
|---|---|---|---|
| Mar. 20, 1983 | [JP] | Japan | 58-44837 |
| Mar. 23, 1983 | [JP] | Japan | 58-41908 |
| Mar. 29, 1983 | [JP] | Japan | 58-45228 |
| Mar. 30, 1983 | [JP] | Japan | 58-44826 |
| Mar. 31, 1983 | [JP] | Japan | 58-47520 |

[51] Int. Cl.[4] ..... B43K 7/02

[52] U.S. Cl. ..... 401/217; 401/135

[58] Field of Search ..... 401/217, 135

[56] References Cited

U.S. PATENT DOCUMENTS

| | | | |
|---|---|---|---|
| 2,505,211 | 4/1950 | Schiesel | 401/217 |
| 2,778,337 | 1/1957 | Lovejoy | 401/217 X |
| 2,871,824 | 2/1959 | Sams | 401/217 |
| 3,216,398 | 11/1965 | Washcalus | 401/217 |
| 3,282,254 | 11/1966 | Malm et al. | 401/217 |

FOREIGN PATENT DOCUMENTS

| | | | |
|---|---|---|---|
| 2154334 | 5/1972 | Fed. Rep. of Germany | 401/217 |
| 976875 | 3/1951 | France | 401/217 |
| 68562 | 5/1978 | France | 401/217 |
| 195628 | 4/1965 | Sweden | 401/217 |
| 651509 | 4/1951 | United Kingdom | 401/217 |
| 1059530 | 2/1967 | United Kingdom | 401/217 |

*Primary Examiner*—Steven A. Bratlie

*Attorney, Agent, or Firm*—Wenderoth, Lind & Ponack

[57] ABSTRACT

A projectable or push-out type writing instrument cartridge, such as a projectable cartridge for a ball point pen, has a filler impregnated with an aqueous ink, a writing point at its one end, a device for feeding the ink to the writing point, and an end plug mounted in the other end of the cartridge. The plug has an air passage which satisfies a predetermined condition. Preferably, the end plug consists of an inner rod and an outer tube which receives the inner rod in such a manner that the air passage is formed between the rod and the tube. The cartridge is secured in the casing of the instrument, and is projectable to a writing position.

5 Claims, 5 Drawing Figures

AQUEOUS INK CARTRIDGE WITH TWO PART VENT PLUG

BACKGROUND OF THE INVENTION

The present invention relates in general to a projectable or push-out type writing instrument using an aqueous writing ink, and more particularly to a cartridge releasably and projectably secured in an instrument body or tubular casing, in which the cartridge contains therein an aqueous ink and a writing point.

A cartridge for the push-out type writing instrument, having a writing point and a filler impregnated with oleaginous ink is known, which is projectably held within a barrel or a casing of, for example, a ball point pen such that push-out operation permits the cartridge to resiliently project from its retracted position to an extended position for writing purposes. A writing instrument such as ball point pen incorporating such a projectable cartridge with oleaginous ink therein as described above is commercially available in the market. The oleaginous ink has a relatively high viscosity.

Many attempts and proposals have been made to provide a writing instrument using, in place of oleaginous ink, an aqueous ink which has been accepted widely as being capable of clear, smooth and fine writing, relative to the oleaginous ink. The attempts, however, have not been successfully matured into a practical application or actual project. One of the principal reasons for failure in practical application is based upon technological difficulties in producing a sealed (or air-tight) chamber in the casing of the writing instrument for preventing ink-shortage or ink-thinning due to drying by the air entering through a small air hole, which is generally provided for the purpose of smooth ink feeding action, at a front portion of the instrument. It is quite difficult to successfully provide such an air-tight chamber, and the present inventors have tried to provide the air hole at a rear end portion of the writing instrument.

However, repeated experiments have revealed some difficulties as set forth below.

(1) a water content in aqueous ink contained in an ink reservoir was greately decreased under a certain condition, for example, at the time of low humidity, to result in a highly increased viscosity of the aqueous ink in the ink reservoir, resulting in an unfavorable feeding of ink to the writing tip; and (2) the air hole was made smaller so as to avoid an excessive decrease of water content in the aqueous ink, and then it was found that ink was not fed fully enough to the writing point, resulting in thinned and unreadable writing.

SUMMARY OF THE INVENTION

An object of the present invention is to provide an improved projectable cartridge for a writing instrument such as a ball point pen, wherein the cartridge contains therein aqueous ink and is releasably and projectably mounted in a casing of the writing instrument.

Another object of the present invention is to provide a projectable cartridge which incorporates an end plug having an air passage which can prevent drying or highly increased drying of the aqueous ink and, at the same time, ink can be fed to the writing point in a smooth manner.

Briefly, the present invention provides a cartridge releasably and projectably mounted in a casing of the push-out type writing instrument, in which the projectable cartridge has a closure member or end plug fitted to the cartridge housing, and an air passage in the end plug. The air passage has a formation such that it falls within a predetermined condition.

In the present invention, the air passage is formed to satisfy the condition that when the difference of atmospheric pressure between the inside and outside of the cartridge is 0.02 atm, the amount of the air passing through the air passage falls within the range of 0.02 to 1.0 cc/second.

Preferably, the end plug is formed with two separate members joined together. In a preferred embodiment, an inner rod member is inserted into and received in an outer cylindrical (tubular) member. A straight or curved air passage is provided between the outer cylindrical member and the inner rod member. Preferably the inner rod member is formed of a relatively hard plastic material and the outer cylindrical member of a relatively soft plastic material.

DETAILED DESCRIPTION OF PREFERRED EMBODIMENT OF THE INVENTION

Figure 1:
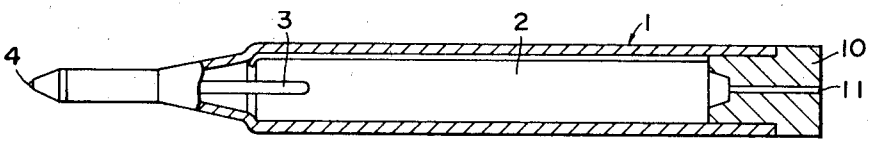
FIG. 1 is a partly sectional view of a cartridge for a writing instrument embodying the invention.

In FIG. 1 which shows a first embodiment of the invention, reference numeral 1 generally designates a cartridge to be projectably mounted in a casing (not shown) of a writing instrument. The illustrated cartridge 1 holds therein an ink reservoir or filler 2 impregnated with an aqueous ink, an elongated rod 3 for feeding ink toward a writing point 4, which is a ball of a ball-point pen in the illustrated embodiment, and an end plug 10 having an air space or passage 11, the end plug 10 being press-fitted to the rear end of the cartridge body.

Experiments were made on the cartridge 1 of the structure illustrated in FIG. 1, by varying the amount of air passing through the air passage 11 of the end plug 10. Ink used in the experiments consists of 25 weight part of ethylene glycol, 10 weight part of dye (black) and 65 weight part of water. The amount of air was changed in the experiments by varying the diameter and length of the air passage. Results of the experiments are as set forth below:

| | *1 Air Amount (cc/sec) | *2 Diameter (mm) | *3 Length (mm) | *4 Fast Writability | *5 Dry Resistance (Wet State) |
|---|---|---|---|---|---|
| Example 1 | 0.05 | 0.4 | 15 | good | 70–80 days |
| Example 2 | 0.15 | 0.4 | 12 | good | 70–80 days |
| Example 3 | 1.0 | 0.5 | 10 | good | 60–70 days |
| Comparative Example (1) | 0.01 | 0.12 | 15 | Writing was thinned. | 100 days and more |
| Comparative Example (2) | 5.0 | 0.7 | 3 | good | 20–30 days |
| Comparative Example (3) | 10.0 | 1.0 | 5 | good | 20–30 days |

*1: Air amount (cc/sec) passing through the air passage 11. Measurements were made by the use of a leak tester made by Kahushiki Kaisha Tokyo Seimitsu (model L-SD-12P-L) under the condition of a primary pressure of 0.02 Kg/cm$^2$, filling time of 0.5 second and inspection time 0.5 second.
*2,*3: Diameter and length, respectively, of the air passage 11 of the end plug 10.
*4: "Fast-writability" means a capability and property of fast writing. Straight lines were written continuously at the speed of 20 cm/speed, and evaluated by visual tests.
*5: Dry resistance or wet state was obtained by measuring days until written lines became thinned while the ball point pen was kept under the conditions of temperature of 50° C. and humidity of 30%.

As will be understood from the experimental results, by selectively changing the size of the air passage 11, which is defined by the amount of air passing through the air passage, the writing instrument having an air passage that falls within the ranges was still usable after it was kept for a long period of time with its writing point exposed to the atmosphere. The writing point and the other ink feeding elements were not dried but remained wetted, and the instrument provided a desirable writing without any thinned ink.

A modified structure of the end plug 10 incorporating an air passage will be described with reference to FIGS. 2 and 3. In this embodiment of the invention, the end plug 10 tightly press-fitted in the rear end of the cartridge body 1 consists of an inner rod member 12 and an outer cylindrical member 13.

The inner rod member 12 has a body portion 14 having a circular cross section and an elongated rod portion 15 integrally formed with the body portion 14. The elongated rod portion 15 has a flattened portion 16 along the length of the rod portion 15. The outer cylindrical member 13 has a front portion 17 press-fitted into the cartridge body 1 and a rear portion 18 which has an inner diameter substantially equal to the maximum diameter of the elongated rod portion 15 of the inner rod member 12. The inner rod member 12 is inserted into the outer cylindrical member 13 to form a straight-lined air passage 11 which is communicated with the ink reservoir 2 through an air space 19 defined between the body portion 14 and the front portion 17 and a slit 20 in the outer cylindrical member 13. As illustrated in FIG. 2, the air space 19 is curved or fluted by shoulders 13*a*, 13*b* so as to prevent ink impregnated in the filler or ink reservoir 2 from running directly to the air passage 11 when a shock is given to the cartridge. The air passage 11 is formed to satisfy the condition that when a difference of atmospheric pressure between the inside and the outside of the cartridge is 0.02 atm., the amount of air passing through the air passage 11 is 0.02–1 cc/second.

Figure 2:
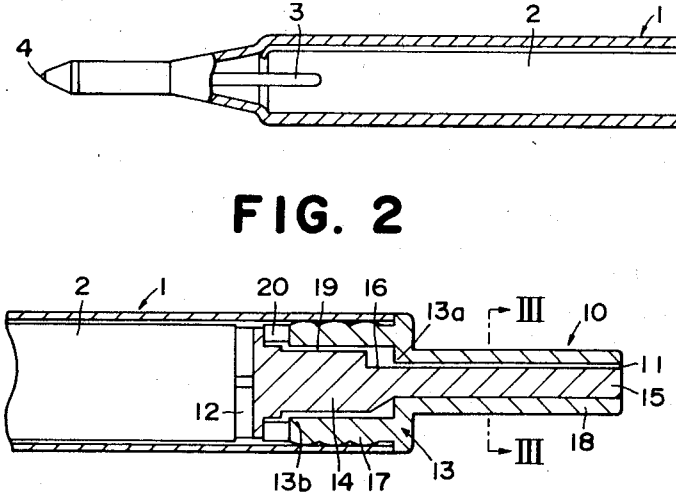
FIG. 2 is an enlarged, longitudinally sectional view of a part of a cartridge according to another embodiment of the invention, showing an end plug formed with two separate members and air passage in a straight-line configuration between the two members.
Figure 3:
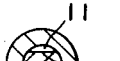
FIG. 3 is a cross sectional view of the end plug, taken along the line III—III of FIG. 2.

In the embodiment of FIGS. 2 and 3, the air passage 11 is provided by forming a flattened portion 16 on the elongated rod portion 15 of the inner rod member 12. Alternatively, the air passage 11 may be provided by forming a groove on the inner surface of the outer cylindrical member 13, into which the inner rod member having a circular cross section is inserted.

Figure 4:
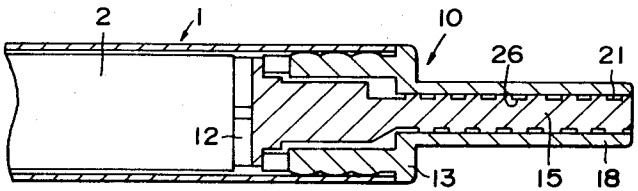
FIG. 4 is a sectional view of a part of a cartridge according to another embodiment of the invention, showing an air channel in a spiral configuration.

FIG. 4 shows another embodiment of the invention, in which an air passage 21 is formed in a curved or spiral configuration. The spiral air passage 21 is formed by simply providing a spiral groove 26 on the elongated rod portion 15 of the inner rod member 12. Alternatively, the spiral air passage can be made by simply forming a spiral groove on inner surface of the rear portion 18 of the outer cylinder member 13. The elongated rod portion 15 of the inner rod member 12 is press-fitted into the rear portion 18 of the outer cylindrical member 13.

In the embodiments of either FIG. 2 or FIG. 4, the end plug 10 is preferably formed of plastic or synthetic resins. Preferably, the outer cylindrical member 13 is made of relatively soft resins such as soft polyethylene, vinyl acetate, vinyl chloride, heat-resisting rubber, etc. and the inner rod member 12 is formed of relatively hard resin such as polypropylene, polyacetal, polyester terephthalate, etc. Thus, the outer cylindrical member 13 is outwardly extended or stretched when the inner rod member 12 is press-fitted into the outer cylindrical member 13 if the inner rod member 12 is formed larger than the predetermined dimension, even though some dimensional scattering or ununiformity in the parts 12, 13 should occur, and therefore non-uniformity of the air passage itself can be avoided.

Figure 5:
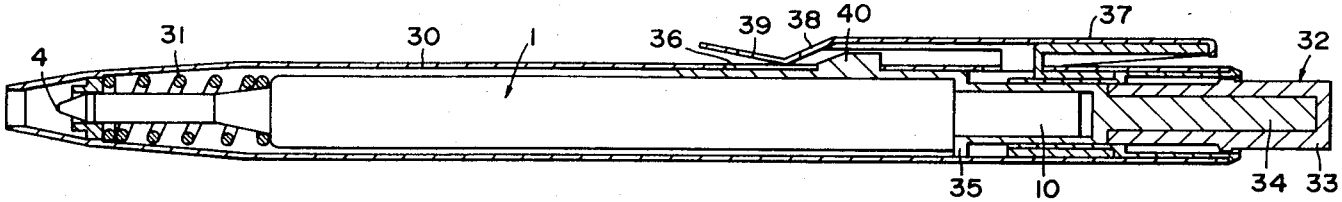
FIG. 5 is a partly sectional elevation of a writing instrument incorporating the cartridge according to the present invention.

FIG. 5 is a partly sectioned view of a writing instrument incorporating the cartridge 1 according to the present invention. Reference numeral 30 is a tubular casing of the push-out type writing instrument, and the projectable cartridge 1 is biased rearwardly within the tubular casing by means of a spring 31, and reference numeral 32 represents an example of a structure of a projection mechanism which, by manipulative operation of a pusher 33 in the illustrated embodiment, holds the cartridge 1 in a projected or advanced position (not shown) against a resilient force of the spring 31. In the illustrated push-out type projection mechanism 32 using the pusher 33 at the end of the instrument, the pusher 33 has an engagement member 34 and is axially movable for a predetermined distance. The engagement member 34 has a portion 35 which engages with the rear end of the cartridge 1, and a locking portion 40 which projects outwardly from an elongated aperture 36 of the tubular casing 30. Reference numeral 37 designates a clip or holding member provided at the outer rear portion of the tubular casing 30. The holding member 37 has at its front portion a V-shaped portion 38, and a hole 39 at the V-shaped portion, in a facewise relation with the elongated aperture 36 of the tubular casing 30.

In order to move the writing point 4 of the cartridge 1 to a projected position, the pusher 33 is pushed forwardly into the tubular casing 30 so that engagement member 34 pushes the cartridge 1 forwardly against the resilient force of the spring 31. At the same time, the locking portion 40 of the engagement member 3 is moved forwardly along the elongated aperture 36 of the casing 30 to move a front portion of the holding member 37 outwardly. Thereafter the locking portion 40 passes over the V-shaped portion 38 and engages with the hole 39 to thereby hold the cartridge 1 in an advanced position, in which the writing point 4 projects from the tubular casing 30. When the projected cartridge is to be retracted into the tubular casing 30, the engagement between the locking member 40 and the hole 39 of the holding member 37 is released by merely pulling the front portion, or pushing the rear portion, of the holding member 37. When the engagement is released, the cartridge 1 is retracted by the force of the spring 31.

Although the present invention has been described with reference to the preferred embodiments thereof, many modifications and alterations can be made within the spirit of the invention.

What is claimed:

1. A writing instrument cartridge for being projectably mounted in a casing of a writing instrument, said cartridge comprising:

a filler impregnated with aqueous ink;

ink feeding means connected to said filler;

a writing point at one end of the cartridge to which said ink feeding means is connected; and an end plug at the other end of said cartridge with one end exposed outside and the other end inside said cartridge, said end plug having an unapertured inner member and an outer member receiving said inner member therewithin and having at least part of the inner surface thereof spaced from the outer surface of said inner member to define an air passage between said inner member and said outer member extending from said one end to the other end of said end plug, said air passage having a size and shape for, when the difference in atmospheric pressure between the inside and the outside of said cartridge is 0.02 atm. passing an amount of air therethrough within the range of 0.02 to 1 cc/sec.

2. A cartridge according to claim 1 wherein said inner member is a rod-like member and said outer member is a tubular member.

3. A cartridge according to claim 2 wherein said inner rod-like member has an elongated rod portion and said outer tubular member has a rear portion receiving said rod portion therein, said rod portion having a flat portion along its length for giving the air passage a straight-line configuration.

4. A cartridge according to claim 2 wherein said inner rod-like member has an elongated rod portion and said outer tubular member has a rear portion receiving said rod portion therein, said rod portion having a spiral groove on the surface thereof along its length for giving the air passage a spiral configuration.

5. A cartridge according to claim 2 wherein said inner rod-like member is made of a relatively hard plastic and said outer tubular member is made of a relatively soft plastic.

* * * * *